United States Patent [19]

Azari

[11] Patent Number: 4,744,560

[45] Date of Patent: May 17, 1988

[54] EXERCISING AND BODY FITNESS ASSEMBLY

[76] Inventor: John Azari, 611 E. 7th St., Hialeah, Fla. 33010

[21] Appl. No.: 886,911

[22] Filed: Jul. 18, 1986

[51] Int. Cl.[4] ..... A63B 21/06

[52] U.S. Cl. ..... 272/118; 272/123; 272/134

[58] Field of Search ..... 272/93, 116, 117, 118, 272/123, 134, 144

[56] References Cited

U.S. PATENT DOCUMENTS

| | | | |
|---|---|---|---|
| 3,524,644 | 8/1970 | Kane | 272/134 |
| 3,902,717 | 9/1975 | Kulkens | 272/134 |
| 4,286,782 | 9/1981 | Fuhrhop | 272/134 X |
| 4,358,108 | 11/1982 | Voris | 272/118 |
| 4,390,179 | 6/1983 | Szkalak | 272/118 |
| 4,564,194 | 1/1986 | Dawson | 272/118 X |
| 4,572,505 | 2/1986 | Kornhaus | 272/96 |

FOREIGN PATENT DOCUMENTS

| | | | |
|---|---|---|---|
| 642552 | 4/1984 | Switzerland | 272/96 |

OTHER PUBLICATIONS

Universal Exercise Equipment Catalog, 1980-81, Aug. 1980, pp. 12 and 18.

*Primary Examiner*—Richard J. Apley
*Assistant Examiner*—Robert W. Bahr
*Attorney, Agent, or Firm*—John Cyril Malloy

[57] ABSTRACT

An exercising structure of the type incorporating a plurality of exercising assemblies on a substantially compact frame wherein the overall structure is of a relatively reduced size so as to be operatively positioned within a reduced area thereby providing complete exercising facilities in a substantially single apparatus without the need for increased space or area such as in a gymnasium.

19 Claims, 3 Drawing Sheets

EXERCISING AND BODY FITNESS ASSEMBLY

BACKGROUND OF THE INVENTION

1. Field of the Invention

This invention relates to an exercising apparatus and body fitness center including a plurality of substantially independent exercising assemblies specifically designed for the exercising of different muscle groups and all of which are contained on a common support frame. The plurality of exercising assemblies and support frame are cooperatively disposed and structured in a substantially compact facility for set up in a relatively small area such as in the residence, business location, etc.

2. Description of the Prior Art

In recent years, body fitness has become increasingly popular with people of all ages. Fitness and the expected health benefits are generally accomplished through the practicing of a continuous and in some cases rather stringent exercise program. Naturally, the type and degree of exercise depends not only on age, state of health, personal goals, but also on the location of the person desiring to exercise and generally on the availability of exercising equipment and/or facilities.

Certain aerobic exercises have gained wide popularity and include aerobic dance, jogging, etc. Generally, these categories of exericse do not require any specific equipment but only proper dress, such as shoes, etc., such as when jogging. Also, the type of exercise generally determines the condition of the body which is being improved. Jogging and aerobics for instance generally aid the circulatory system, use up excess calories and adds to the overall health and well being of the person conducting such type of exercise.

However, other types of exercise primarily associated wth body building or the strengthening or training of certain muscle groups almost always requires the access to certain weights or like equipment or machinery. The category of equipment utilized often includes universal type equipment commercially available under the trade name "Nautilus".

Whether one utilizes either the free weights or the universal type equipment, space and efficient exercising technique are primary concerns. The universal equipment referred to above is frequently presented in a number of separate machines or equipment specifically designed to exercise one or possibly more associated groupings of muscles. However, it is also well recognized that a plurality of such machines required to exercise the majority of the muscle groupings of the body is both extremely expensive and requires a large area such as a gymnasium or at least a fairly good size room in which such equipment must be housed.

Accordingly, there is a need in the exercise equipment industry for a relatively compact substantially self-contained exercising structure or facility which includes a plurality of exercising assemblies each designed for what may be referred to as "heavy duty" exercise designed to accomplish serious body building. The exercising facilities can be maintained in a relatively small area and can be purchased and maintained at a relatively low price compared to the purchase, set up and maintenance of a plurality of different universal type machines.

SUMMARY OF THE INVENTION

This invention relates to an exercising facility more specifically designed to be set up and operated in a relatively small space or area. The exercising structure of the present invention thereby is capable of being adapted for use in the residence, at business or any other area without taking up excessive room.

More specifically, the exercising apparatus of the present invention comprises a support frame having a base with an elongated and preferably linear configuration extending along the length thereof. Outwardly extending supplemental supports are secured to the base and provide lateral stability to the support frame. A plurality of spaced apart stanchions extend upwardly and in coplanar relation to the base and are secured in supporting relation to a header structure.

A plurality of substantially independent exercising assemblies are secured to the support frame wherein an important feature of the present invention which, adds to its compactness and versatility, include a primary support secured to the base. The primary support of each exercising assembly not only is structured to substantially support the remainder of the respective exercising assemblies but is structured to be positioned in substantially coplanar relation to the base and to the stanchions and header structure.

As part of the plurality of exercising assemblies, a plurality of collections of weights are also utilized to accomplish preferred exercising routines when used in combination with one or more of the plurality of exercising assemblies.

It should further be noted that each of the plurality of exercising assemblies is specifically structured to have what may be considered "heavy duty" exercising routines performed thereon. Accordingly, the subject exercising apparatus or facility, while compact and capable of being set up and used in the home or business office, is capable of providing complete and thorough workout to the extent of allowing a user thereof to significantly build up his body generally and specific muscle groups.

As set forth above, each of the plurality of exercising assemblies may be operated independently of the other but in some instances, exercising assemblies may be used cooperatively to perform a given exercise or routine. More specifically, one of the plurality of collections of weights may be used to accomplish pull downs while sitting on a seat associated with an exercising assembly used to exercise the calves, biceps, shoulders or triceps.

Further, and as set forth above, the primary support of each exercising assembly is secured to the base of the support frame and extends upwardly therefrom. However, in at least one of the subject exercising assemblies, the primary support may be removed to modify the configuration or structure of a given exercising assembly or make way for the utilization of an additional exercising assembly.

Additionally, pads, benches, and like auxiliary structures may be utilized in combination with the support frame or any one or all of the plurality of exercising assemblies to accomplish a given exercising routine or to add safety and/or comfort in the operation of a given exercising assembly.

The invention accordingly comprises features of construction, a combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawing in which.

Like reference numerals refer to like parts throughout the several views of the drawing.

DETAILED DESCRIPTION OF THE PREFERRED EMBODIMENT

Figure 1:
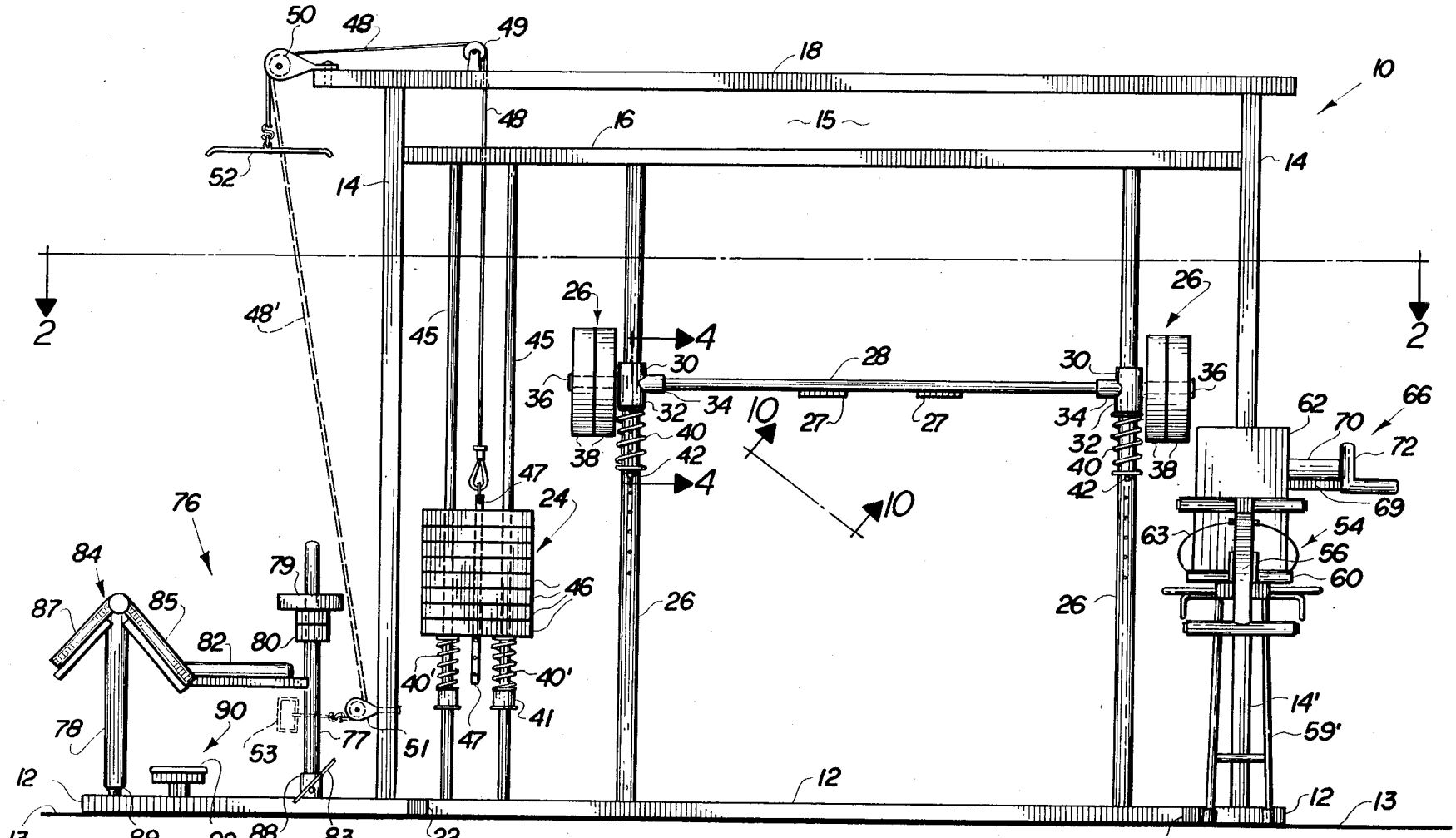
FIG. 1 is a front plan view of the exercising structure of the present invention showing a plurality of exercising assemblies incorporated thereon.

As shown in FIG. 1, the exercising structure of the present invention is generally indicated as 10 and includes a support frame on which a plurality of exercising assemblies are mounted. The support frame includes a base 12 having a substantially elongated and in the embodiments shown in FIGS. 1 and 2, a linear configuration extending substantially the length of the support frame. A plurality of stanchions 14 are secured to base 12 and also comprise a portion of the support frame. The stanchions 14 are spaced apart from one another and extend vertically upward from the base and in coplanar relation thereto into a supporting and interconnected relation to a header structure 15. The header strcuture includes two elongated cross bars 16 and 18 also having a linear configuration and also disposed in coplanar relation with the base 12 and the stanchions 14. Further, outwardly extending supports 22 define a portion of the support frame and extend outwardly, preferably in perpendicular relation to the base 12. The supports 22 are, in their spaced apart and outwardly extended position, relative to one another and to the base 12 respectively, provides lateral stability to the support frame especially when one or more of the exercising assemblies are being utilized.

In addition to the plurality of exercising assemblies associated with the support frame of the subject exercising structure 10, a plurality of collections of weights including at least a first collection generally indicated as 24 and a second collection generally indicated at 26 are provided to accomplish exercising of certain muscle groups and are used, as explained in greater detail hereinafter, in combination with certain ones of the plurality of exercising devices.

As best shown in FIG. 1, the plurality of exercising assemblies comprise a first exercising asssemblies including two spaced apart elongated support rods 26 having one end fixedly secured to base 12 and extending upwardly therefrom in coplanar relation thereto in fixed connection with crossbar 16 at the header 15. The primary support of the exercising assembly includes the spaced apart support rods 26 being disposed in coplanar relation and connected to the base 12. A lift bar 28 extends between and is generally interconnected to the support rods 26 by end connector members 30. As shown clearly in FIGS. 1 and 4, each of the connectors 30 includes a cylindrical sleeve 32 disposed in surrounding relation to the respective support rods 26 so as to move along the length thereof. Each of the connectors 30 further includes a receiving channel 34 to receive appropriately positioned end of the lifting bar 28 as shown in FIG. 1. Outwardly extending members 36 define extensions of the lift bar 28 and move therewith as they are fixedly secured to the sleeve 30 (see FIG. 1). Further, the members 36 have a sufficient elongated configuration to have mounted thereon at least one but preferably a plurality of weights 38 of a first collection of weights generally indicated as 26.

Further features of the first exercising assembly include a shock absorbing means in the form of a coil spring 40 disposed in surrounding relation to the respective support rods 36 and positioned so as to be able to be adjustably positioned along their length. Stop members 42 are defined by elongated pins (see FIG. 4) capable of passing through any one of a plurality of apertures 44 extending completely through a section or length of the respective support rods 26.

Figure 4:
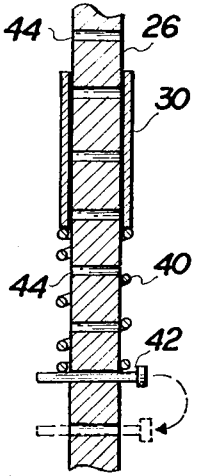
FIG. 4 is a sectional view taken along line 4—4 of FIG. 1.

A further review of FIGS. 1 and 4 indicates that the pins, 42, regardless of their placement, in any one of the plurality of apertures 44 is disposed in abutting and supporting relation to the shock absorbing springs 40 which in turn are disposed in supporting shock absorbing relation to the sleeves 30. Therefore, the lift bar 28 with weights 38 attached, is capable of performing numerous exercises such as military presses, bench presses, etc. depending upon the location of the rod or height from the base 12. However, in any of its many positions, the support rod has a safety feature of providing shock absorptions due to be existence of the springs 40 and support pins 42 which will cushion the fall or dropping of the cross bar 28 with the weights 38 attached thereto.

The first collection of weights 24 is movable in a vertical path of travel which such path of travel is restricted by parallel spaced apart elongated poles 45. The first collection of weights 24 comprises a plurality of weights 46 stacked upon one another wherein each includes an apertured construction defined by a pair of apertures in each weight (see FIGS. 5 snd 6) to accommodate the extension of the respective poles 45 completely therethrough.

Figure 5:
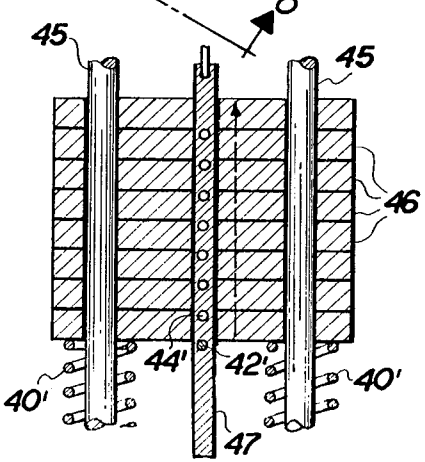
FIG. 5 is a sectional view of one of a plurality of collections of weights taken in partial cutaway and showing details thereof.
Figure 6:
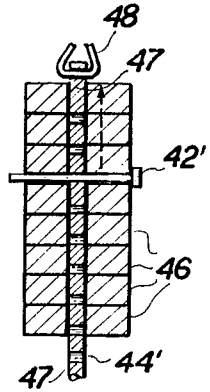
FIG. 6 is a sectional view of the embodiment of FIG. 5 in partial cutaway.
Figure 8:
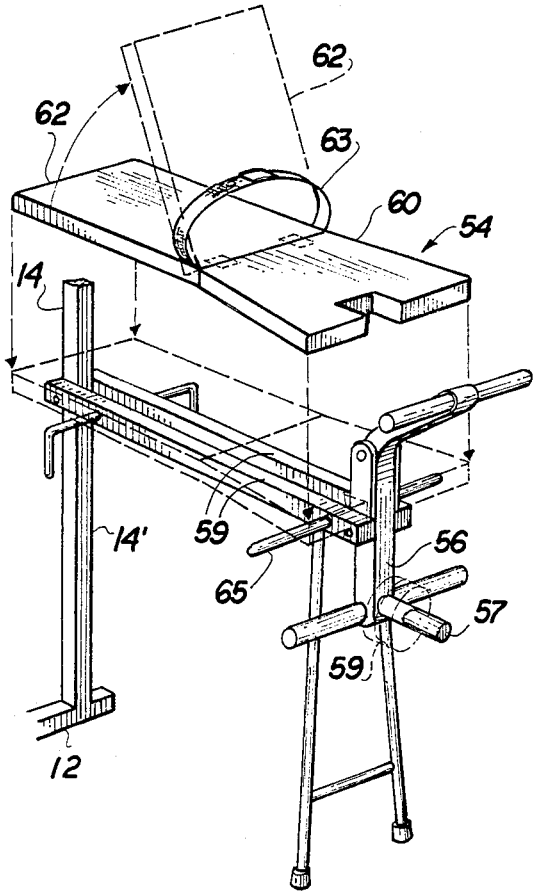
FIG. 8 is a perspective view in partial cutaway along line 8—8 of FIG. 2 showing yet another of the plurality of exercising assemblies.

A central shaft 47 extends through a center aperture in each of the weights 46 wherein the upper end thereof as at 47' is connected to a cable 48 which is part of a cable and pulley assembly. The pulleys 49 and 50 are secured to the header structure and more specifically to the upper cross member 18 so as to define a path of travel of the cable 48. The end of the cable 48 is secured to a conventional pull down bar 52 for proper exercising of the shoulder muscles and related muscle groupings. It is readily seen therefor that upon a pulling force being exerted on bar 52 a plurality of weights 46 travel along a restricted path of travel defined by the spaced apart parallel poles 45. The number of weights of course can be varied, by a similar support or connector pin 42' passing through any one of a plurality of apertures 44'. Depending upon the placement of the pin 42' the number of weights to be lifted by the pulley and cable assembly is determined as best shown in FIGS. 5 and 6. A second exercising assembly is generally indicated as 54 and as shown in detail in FIG. 8 and more specifically in FIGS. 1 and 2. The second exercising assembly 54 is primarily designed to exercise the legs including leg lifts and reverse leg curls and includes a pivoted leg engaging member 56 specifically including an outwardly extending arm 57 on which a third collection of weights 59 may be mounted to add resistance during the leg exercises. A primary support for the second exercising assembly includes a portion of stanchion 14 as at 14' (see FIG. 8) positioned in coplanar relation to the base 12. Cross members 59 provide the main support and extend outwardly from the stanchion 14 as the primary support to the pivoted member 56 providing support for the weights 59 and as well as the resistance to the legs of the user. Further, a support bench or padding 60 may be disposed in a number of angled positions so as to provide a proper inclined support to the back of the user as at 62. Belt or strapping serves to hold in and properly position the lower hips or torso portion of the body as indicated at 63. Handles 65 are provided to engage the hands of the user and again serves to stabilize the person exercising during the leg lifting exercises. Finally, an auxiliary support 59 is provided to effectively support the outwardly extending or distal end of the cross bars 59 such that while the primary support 14' of the second exercising assembly 54 is in coplanar relation to the base 12, the remainder of the exercising assembly 54 extends laterally outwardly from the base and support frame to provide adequate space for accomplishing exercising routines on this exercising assembly 54.

Figure 2:
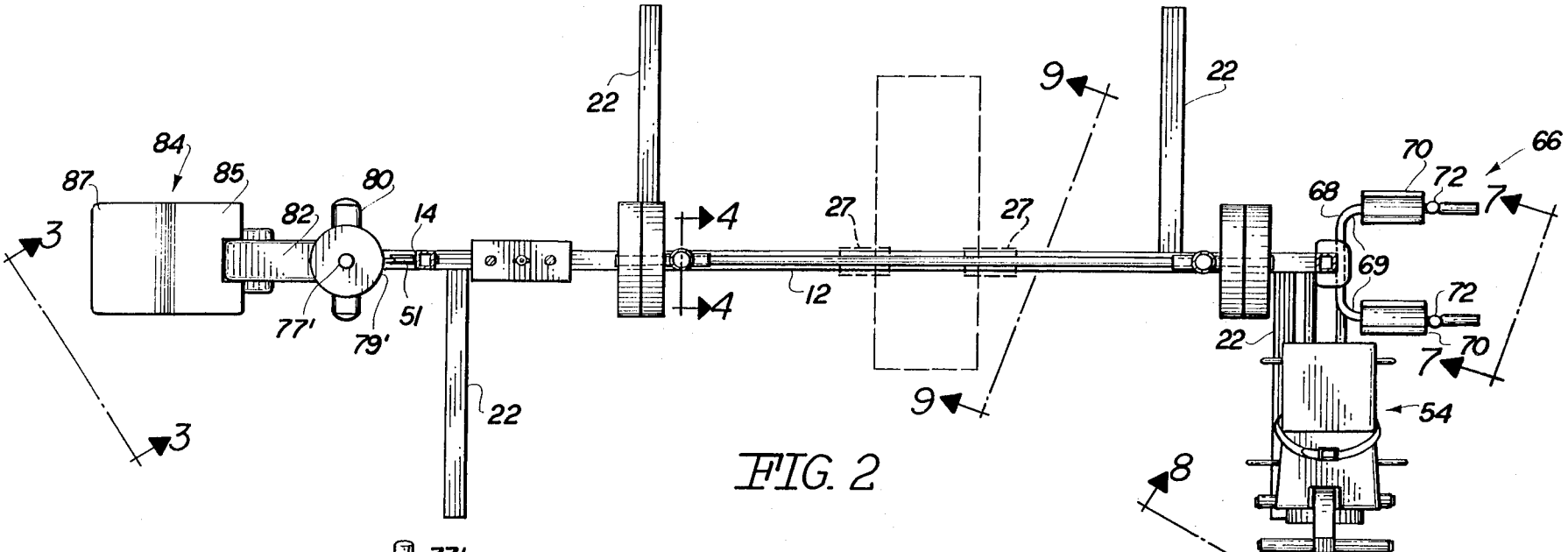
FIG. 2 is a top sectional view taken along line 2—2 of FIG. 1.
Figure 7:
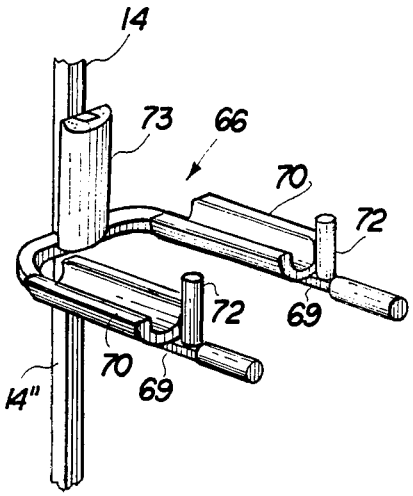
FIG. 7 is a perspective view in partial cutaway along line 7—7 of FIG. 2 showing details of another of a plurality of exercising assemblies.

As shown in detail in FIG. 7 and also in proper relation to the support frame in FIGS. 1 and 2, the third exercising assembly generally indicated as 66 includes a substantially U-shaped support or brace 68 defining two outwardly extending parallel and spaced apart arms 69 each of which include a saddle 70 for the support of the forearm such that the exerciser stands in the space between the arms 68 so as to rest the upper portion of the arm substantially adjacent the elbow as well as the outwardly extending forearm therein. Perpendicularly disposed handles 72 are disposed to provide firm gripping engagement in order to lift the lower body portion which may be considered suspended from the arm support or cradle or saddle 70. It is also important to note that the primary support for the third exercising assembly 66 is a portion of the stanchion 14'' which is common to the primary support of the first exercising assembly 44 as at 14'. A padding disposed adjacent the portion 14'' of the stanchion 14 is provided to support and cushion the back of the exerciser as at 73.

Figure 3:
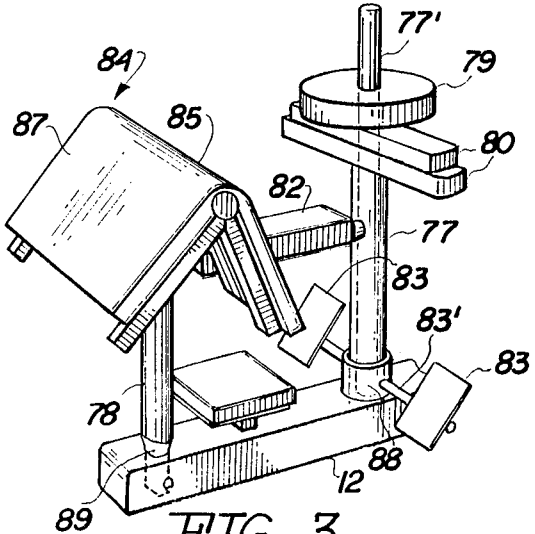
FIG. 3 is a perspective view in partial cutaway showing details of one of the plurality of exercising assemblies of the present invention.

With reference to FIGS. 1, 2 and 3, a fourth exercising assembly is generally indicated as 76 and includes a first primary support 77 and a second primary support 78 both disposed in fixed relation to and extending upwardly from and coplanar with the base 12 as clearly shown in FIG. 1. The first primary support 57 includes a fourth collection of weights as at 79 mounted on a knee or leg lift 80 the undersurface of which is designed to engage the legs in an area right above the knee of the user when the user is positioned in straddle type fashion on the seat structure 82. The feet of the user or exerciser is disposed on movable or pivotable foot plates 83 to provide resistance for the exercising of the calves as when the legs are lifted. The legs are lifted to raise the weight 79 by engagement with the leg lifting member 80 as they engage right above the knee portion.

A reverse orientation of the exerciser when straddling the seat 82 in the opposite direction allows his use on the preacher bench generally indicated as 84 where he may lean over, partially recline on angled surface 85 and use free weights to exercise the biceps as he does curls on the angled surface 87.

Another important feature of the present invention is the ability to remove the first and second primary support 77 and 78 from their connections at 88 and 89, respectively. The removal of the first and second primary support 77 and 78 thereby clears away the fourth exercising assembly 76 and allows the exerciser to use what may be considered as a fifth exercising assembly 90 including a seat portion 92 on which the exerciser is supported in a sitting or crouching fashion very near to but sufficiently above a supporting surface as at 13 on which the support frame is positioned. When in such crouched position on the seat 92, a cable extension as at 48' is connected to a third pulley 51 of the cable and pulley assembly at a far distal end thereof. A handle mechanism 53 may be secured thereto for gripping by the exerciser crouched on seat 92. Accordingly, pulling and rowing action may be exerted to exercise proper muscle grouping as the weights 46 of the first collection of weights 24 is forced to travel and provide resistance upon the pulling of the handle 53, cable extension 48' and cable 48.

Figure 9:
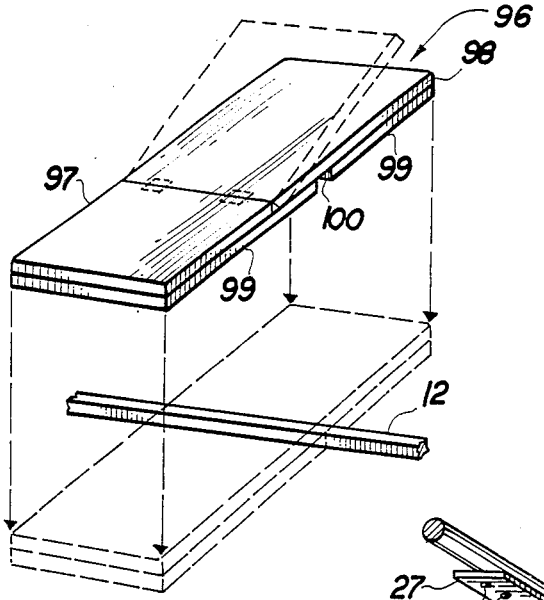
FIG. 9 is a perspective view in partial cutaway along line 9—9 of FIG. 2 showing an auxiliary structure associated with the exercising facility of the present invention.
Figure 10:
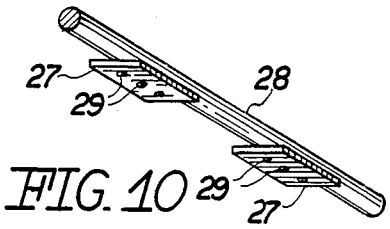
FIG. 10 is a perspective view in partial cutaway along line 10—10 of FIG. 1.

Further with regard to FIG. 9, a padding and/or bench surface 96 may be provided to have a split connected portions 97 and 98 with additional padding features 99 covering the undersurface thereof and separated by elongated channel 100. The channel 100 is of sufficient transverse longitudinal dimension to surround and fit over the base 12 as shown in phantom lines in FIG. 9. By virtue of this construction, a surface is provided on which exercising may be utilized and adequate padding is also provided to provide safety features through the use of the subject exercising assembly.

Further structural features of the present invention is the provision of foot pads 27 secured by screw members 29 or like connectors to the undersurface of the lift bar 28 and positioned a sufficient distance apart so as to allow the feet to be placed thereon for purposes of lifting the weights or weight assemblies as generally indicated as 26 by the feet or legs. In such a position, the person exercising would support himself on the matting or supporting surface (see FIGS. 2 and 9) so that the lift bar could be repeatedly raised and lowered through the exercising of the leg muscles. In order to readily detach such foot pads 27, the plurality of connectors 29 allow for removable attachment and replacement without delay or time-consuming manipulation.

It is therefore to be understood that the following claims are intended to cover all of the generic and specific features of the invention herein described, and all statements of the scope of the invention which as a matter of language, might be said to fall therebetween.

Now that the invention has been described,

What is claimed is:

1. An exercising structure of the type primarily designed to exercise various muscle groups of the human body by utilizing independent exercising assembly, said exercising structure comprising:

(a) a support frame including an elongated base portion disposed on a supporting surface and a header portion disposed in spaced relation to said base and in substantially overhanging relation hereto, (b) a plurality of spaced apart stanchions secured to said base portion and extending upwardly therefrom into said supporting engagement with said header structure, (c) said base portion, header structure and plurality of stanchions each comprising an elongated, substantially linear configuration and disposed in substantially coplanar relation to one another, (d) said base portion further including a plurality of spaced apart lateral supports extending outwardly from opposite sides of said base portion, whereby lateral stability is provided to said support frame;

(e) a plurality of exercising assemblies each having a primary support secured to and disposed in coplanar relation to said support frame, (f) each of said plurality of exercising assemblies disposed in spaced relation to one another and each structured to exercise at least one different muscle group than the other of said plurality of exercising assemblies, (g) a plurality of collections of weights interconnected to said support frame and movably secured to at least one of said plurality of assemblies for disposition along a restricted path of travel, and (h) said plurality of exercising assemblies comprising a primary support secured to said base portion in coplanar relation thereto and including a seat structure and a weight support disposed in cooperative relation to one another, said weight support movable mounted immediately above and in engageable relation to a user's legs above the knee portion thereof and a foot support for each foot of the user disposed adjacent to and at least partially beneath said weight support.

2. A structure as in claim 1 further comprising a cable and pulley assembly interconnected to one of said plurality of collections of weights, said one collection of weights connected in driven relation to said cable and pulley assembly and movable therewith by manipulation of said cable and pulley assembly.

3. A structure as in claim 2 wherein sad cable and pulley assembly comprises a plurality of pulleys secured to said support frame and a cable positioned in movable engagement with said plurality of pulleys, said plurality of pulleys at least partially defining a path of travel of said cable.

4. An assembly as in claim 3 wherein one end of said cable is connected to said one collection of weights and an opposite end of said cable is selectively positionable into operative disposition relative to at least two of said plurality of exercising assemblies.

5. An assembly as in claim 1 wherein said plurality of exercising assemblies comprise a first exercising assembly including two spaced apart support rods defining a primary support for said first exercising assembly and vertically oriented in parallel relation to one another and each connected to both said base and said header structure and being coplanar therewith; a lifting bar having an elongated configuration and being movably connected substantially adjacent each opposite end of said lifting bar to a different one of said support rods, said first exercising assembly further structured for removable connection to and support of a second of said plurality of collection of weights.

6. A structure as in claim 5 wherein first exercising assembly comprises a connector structure secured to each opposition end of said lifting bar, and including a sleeve member dimensioned and configured for surrounding and movable disposition along a length of a respective one of said support rods, whereby said lifting bar and attached second collection of weights are selectively movable along the length of said support rods.

7. A structure as in claim 6 wherein each of said connector structures comprises an arm extending outwardly therefrom and being movable therewith, each of said arms having a substantially elongated configuration of sufficient dimension to removably support at least one weight of said second collection of weights thereon.

8. An assembly as in claim 6 wherein said first exercising assembly comprises shock absorbing means including a spring element disposed in supporting engagement with each of said connector structures and a support finger dimensioned to pass through any one of a plurality of spaced apart apertures formed along a length of said respective support rod.

9. A structure as in claim 8 wherein each of said fingers are disposed in supporting relation to a respective spring element, each of said connector structures and spring elements selectively positionable at varying heights relative to said base portion by selective positioning of said respective finger along the length of said support rod.

10. A structure as in claim 1 wherein said plurality of exercising assemblies include a second exercising assembly having a primary support secured to said base in coplanar relation thereof and extending outwardly therefrom, said second exercising assembly including a leg lift mechanism, pivotally movable by the legs of the user and including a third collection of weights removably supported thereon.

11. A structure as in claim 10 wherein said primary support of said second exercising device is defined by one of said stanchions of said support frame.

12. A structure as in claim 1 wherein said plurality of exercising assemblies include a third exercising assembly including a primary support secured to said base portion and disposed in coplanar relation therewith, said third exercising assembly extending outwardly from said support frame and structured to engage and support a portion of said upper arm, each forearm and the connecting elbow of the user therebetween, whereby a user may lift his lower body portion off the supporting surface and be supported by said third exercising assembly.

13. A structure as in claim 12 wherein said primary support of said third exercising assembly comprise one of said stanchions of said support frame.

14. An assembly as in claim 13 wherein said plurality of exercising assemblies comprises a second exercising assembly having a primary support defined by one of said stanchions of said support frame, said third exercising assembly having said primary support defined by said one stanchion common to second exercising assembly.

15. An assembly as in claim 1 wherein said seat structure is disposed adjacent and in cooperative relation with a preacher's bench device defining a portion of said fourth exercising assembly, said seat structure disposed to face the user toward and in operative position alternately with said preacher's bench and said weight support.

16. An assembly as in claim 15 wherein said primary support of said fourth exercising assembly is removable.

17. An assembly as in claim 16 wherein said weight support is removably secured to said base and in coplanar relation thereto.

18. A structure as in claim 15 wherein said seat structure is disposed beneath and in operative relation to a cable and pulley assembly, one end of said cable and pulley assembly attached to one of said collections of weights for forced movement thereof, said pulley and cable assembly further including a pull down bar secured to an opposite end of a cable portion of said pulley and cable assembly and further disposed in communicating relation with a user on said seat structure, said one collection of weights movable along a restricted path upon force being applied to said pull down bar.

19. An assembly as in claim 1, wherein said plurality of exercising assemblies further comprise a second seat structure having a primary support secured to said base portion in coplanar relation thereto, said second seat disposed in communicating relation with one end of a pulley and a cable assembly, an opposite end of said pulley and cable assembly secured to one collection of weights of said plurality of collection of weights, said one collection of weights movable along a restricted path of travel upon force being applied to said one end of said pulley and cable assembly adjacent to said second seat structure.

* * * * *